US007104099B1

(12) United States Patent
Ghiran et al.

(10) Patent No.: US 7,104,099 B1
(45) Date of Patent: Sep. 12, 2006

(54) CENTER SUPPORT PUNCH ASSEMBLY FOR HYDROFORMING DIE

(75) Inventors: Mike M. Ghiran, Lake Orion, MI (US); Gerry A. Harmon, Clawson, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/204,986

(22) Filed: Aug. 16, 2005

(51) Int. Cl.
*B21D 28/18* (2006.01)
*B21D 28/28* (2006.01)

(52) U.S. Cl. ..... 72/55; 72/370.26; 29/421.1; 83/53

(58) Field of Classification Search ..... 72/55, 72/56, 370.27, 370.26; 83/53; 29/421.1
See application file for complete search history.

(56) References Cited

U.S. PATENT DOCUMENTS 5,398,533 A * 3/1995 Shimanovski et al. ..... 72/55
5,996,455 A * 12/1999 Haag et al. ..... 72/55
6,006,566 A * 12/1999 Huelsberg et al. ..... 72/55
6,401,507 B1 * 6/2002 Krcek et al. ..... 72/55
6,672,120 B1 * 1/2004 Ghiran et al. ..... 72/55
6,681,611 B1 * 1/2004 Haag et al. ..... 72/370.27

* cited by examiner

*Primary Examiner*—David B. Jones
(74) *Attorney, Agent, or Firm*—Laura C. Hargitt

(57) ABSTRACT

A center support punch assembly for a hydroforming die includes a center support member for fixed attachment to a die. The center support punch assembly also includes a button disposed about and space from the center support member for fixed attachment to the die. The center support punch assembly further includes a plunger movable relative to the center support member to allow fluid within a tubular member to force a wall portion of the tubular member outward against the center support member and be sheared by the button to produce an opening in the tubular member.

11 Claims, 6 Drawing Sheets

CENTER SUPPORT PUNCH ASSEMBLY FOR HYDROFORMING DIE

TECHNICAL FIELD

The present invention relates generally to hydroforming and, more specifically, to a center support punch assembly for a hydroforming die.

BACKGROUND OF THE INVENTION

It is known to form a cross-sectional profile of a tubular member by a hydroforming process in which a fluid filled tubular member is placed within a cavity of a die and then the die is closed so that the tubular member is pinched within the die. Fluid pressure is then increased inside the tubular member to expand the tubular member outwardly against the cavity of the die to provide a tubular product having a die formed cross-sectional profile.

During tube hydroforming, large size punches of various shapes are used to create desired openings in the tubular member. These large size punches require similarly large activating hydraulic cylinders in order to overcome the forces needed for piercing the tubular member. Large bore hydraulic cylinders need a high volume of oil flow to operate, which is undesired.

As the number of hydroformed tube applications grows, the need for complex piercing also increases. Tubes are not only designed with more openings, but also with larger openings, which, in turn, need larger hydraulic cylinders for piercing. The need to reduce oil flow for hydraulic cylinder operation as well as to control internal form pressure is becoming more important. The hydroforming industry is constantly searching for ways to reduce the necessary force to pierce openings.

A first method of piercing used in hydroforming applications is hydropiercing. Upon completion of hydroforming, the tubular member is in intimate contact with the wall of the die. The hydroforming fluid is at a forming pressure, approximately 10,000 psi. A punch is attached to a hydraulically actuated cylinder. When the hydraulic cylinder is extended, the high-pressure fluid will support the tubular member around the circumference of the punch, allowing the metal to shear. The punch will shear a slug, which will fall as a loose piece and lay inside the formed tubular member. After the punch extends through the wall of the tubular member, hydroforming fluid will leak out between the punch and the wall of the tubular member. This will cause a significant drop in pressure, which is undesired.

A second method of piercing used in hydroforming applications is "hydrapiercing". Upon completion of hydroforming, the tubular member is in intimate contact with the wall of the die. The hydroforming fluid is at a forming pressure, approximately 10,000 psi. A punch is attached to a hydraulically actuated cylinder. When the hydraulic cylinder is retracted, the high-pressure fluid will force the (non-supported) area of the tubular member outward, allowing metal to be sheared and produce a slug. The "hydrapiercing" method is mostly used for piercing large openings. In order to support the forming pressure of approximately 10,000 psi or more, this method requires large hydraulic cylinders, which is undesired. Packaging as well as more hydraulic flow to operate large cylinders is a constant problem in designing hydroforming dies.

As a result, it is desirable to provide a punch assembly to pierce openings in a tubular member during the hydroforming process. It is also desirable to provide a punch that can withstand extremely high forces. It is further desirable to provide a punch assembly that is more compact than a hydraulic cylinder of equal power. Therefore, there is a need in the art to provide a new punch assembly for a hydroforming die that meets these desires.

SUMMARY OF THE INVENTION

Accordingly, the present invention is a center support punch assembly for a hydroforming die including a center support member for fixed attachment to a die. The center support punch assembly also includes a button disposed about and spaced from the center support member for fixed attachment to the die. The center support punch assembly further includes a plunger movable relative to the center support member to allow fluid within a tubular member to force a wall portion of the tubular member outward against the center support member and be sheared by the button to produce an opening in the tubular member.

One advantage of the present invention is that a center support punch assembly is provided for a hydroforming die that has the ability to withstand extremely high forces. Another advantage of the present invention is that the center support punch assembly results in a significant cost reduction of between 40% and 50%. Yet another advantage of the present invention is that the center support punch assembly uses smaller hydraulic cylinders during hydroforming. Still another advantage of the present invention is that the center support punch assembly has a shorter stroke during hydroforming. A further advantage of the present invention is that the center support punch assembly uses less oil flow during hydroforming. Yet a further advantage of the present invention is that the center support punch assembly allows for a faster process during hydroforming. Still a further advantage of the present invention is that the center support punch assembly provides a significant improvement in the hydroforming process. Another advantage of the present invention is that the center support punch assembly increases the real estate in the hydroform die for better packaging.

Other features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
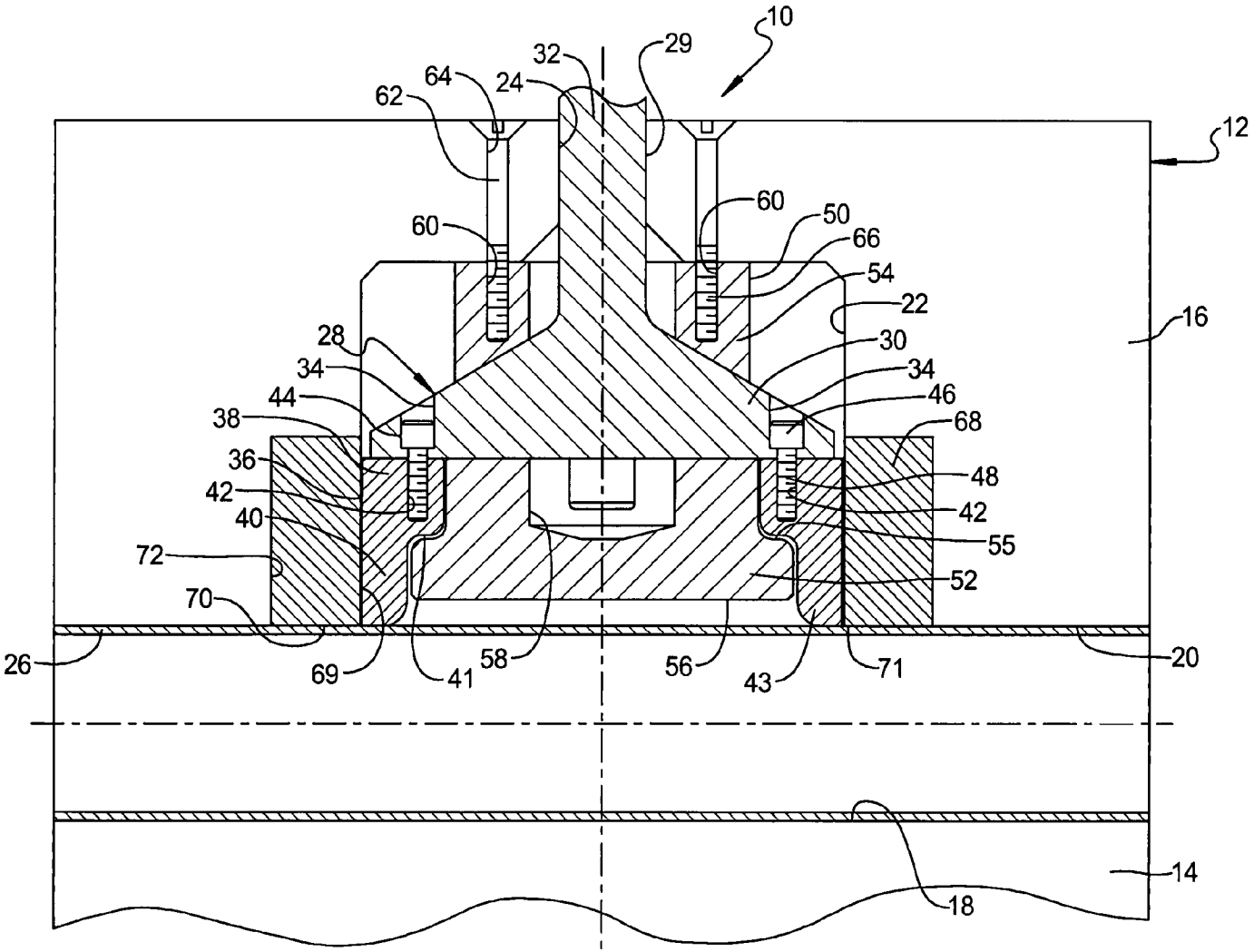
FIG. 1 is a fragmentary elevational view of a center support punch assembly, according to the present invention, illustrated in operational relationship with a tube and hydroforming die.

Referring to the drawings and in particular FIG. 1, one embodiment of a center support punch assembly 10, according to the present invention, is generally shown for a hydroforming die, generally indicated at 12. The hydroforming die 12 is a die set comprised of a lower die half 14 and an upper die half 16. The lower die half 14 includes a tubular forming cavity portion 18. Likewise, the upper die half 16 includes a tubular forming cavity portion 20. The upper die half 16 includes a cavity 22 extending axially from the tubular forming cavity portion 20 and an aperture 24 extending axially from the cavity 22 and therethrough. It should be appreciated that a combined cross-sectional circumferential measure of the tubular forming cavity portions 18 and 20 total up to generally equal to or slightly greater than the cross-sectional circumferential measure of a tubular member 26 disposed in the tubular forming cavity portions 18 and 20.

The punch assembly 10 also includes a plunger, generally indicated at 28, disposed within the upper die half 16. The plunger 28 includes a plunger member 29 having a head portion 30 extending radially and a shaft portion 32 extending axially from the head portion 30. The head portion 30 has a diameter greater than a diameter of the shaft portion 32. The head portion 30 has a generally pentagonal cross-sectional shape. The head portion 30 has at least one, preferably a plurality of apertures 34 extending axially therethrough. The head portion 30 is disposed in the cavity 22 and the shaft portion 32 extends through the aperture 24. The plunger member 29 is made of a rigid material such as metal. The plunger member 29 is a monolithic structure being integral, unitary, and one-piece. It should be appreciated that the plunger member 29 is attached to a hydraulically actuated cylinder (not shown).

The plunger 28 also includes a forming member 36 attached to the plunger member 29. The forming member 36 is generally ring shaped having an inverted and generally "L" cross-sectional shape. The forming member 36 has a base portion 38 extending radially and an arm portion 40 extending axially from the base portion 38 to form a shoulder 41 therebetween. The base portion 38 has a radial width greater than a radial width of the arm portion 40. The base portion 38 includes at least one, preferably a plurality of threaded cavities 42 extending axially therein. The arm portion 40 has an arcuate surface 43 at one end thereof. The forming member 36 is made of a rigid material such as metal. The forming member 36 is a monolithic structure being integral, unitary, and one-piece.

The plunger 28 includes at least one, preferably a plurality of fasteners 44 to attach the plunger member 29 and the forming member 36 together. The fasteners 44 have a head portion 46 disposed in the apertures 34 in the head portion 30 and a threaded shaft portion 48 that threadably engages the threaded cavities 42 in the base portion 38. It should be appreciated that the fasteners 44 are conventional and known in the art. It should also be appreciated that any suitable fastening mechanism may be used to attach the plunger member 29 and forming member 36 together. It should further be appreciated that the plunger 28 is movable relative to the upper die half 16.

The punch assembly 10 also includes a center support member 50 disposed in the cavity 22 and attached to the upper die half 16. The center support member 50 has a base portion 52 extending radially and an arm portion 54 extending axially from the base portion 52 to form a shoulder 55 therebetween. The base portion 52 has a radial width greater than a radial width of the arm portion 54. The base portion 52 has a tube contact surface 56 to contact the tubular member 26 for a function to be described. The arm portion 54 has a generally "U" shaped cross-section to form a central cavity 58. The arm portion 54 also has at least one, preferably a plurality of threaded cavities 60 extending axially therein for a function to be described. The center support member 50 is made of a rigid material such as metal. The center support member 50 is a monolithic structure being integral, unitary, and one-piece. It should be appreciated that the arm portion 54 of the center support member 50 has a slot to allow the head portion 30 of the plunger 28 to extend therethrough.

The punch assembly 10 includes at least one, preferably a plurality of fasteners 62 to attach the center support member 50 to the upper die half 16. The fasteners 62 extend through apertures 64 in the upper die half 16 and have threaded ends 66 that threadably engage the threaded cavities 60 in the arm portion 54 of the center support member 50. It should be appreciated that the fasteners 62 are conventional and known in the art. It should also be appreciated that any suitable fastening mechanism may be used to attach the center support member 50 to the upper die half 16. It should further be appreciated that the center support member 50 is fixed or stationary relative to the upper die half 16.

The punch assembly 10 further includes a button 68 disposed about the cavity 22 and supported upon the upper die half 16. The button 68 is a generally annular ring having an aperture 69 extending axially therethrough. The button 68 has a tube contact surface 70 and a sharp edge 71 formed by the aperture 69. The button 68 is disposed in an annular recess 72 disposed about the cavity 22 and connected to the upper die half 16 by a suitable mechanism such as press-fitting. The button 68 is made of a metal material. It should be appreciated that the button 68 is fixed or stationary relative to the upper die half 16.

In operation, the tubular member 26 is disposed between the lower die half 14 and upper die half 16. The punch assembly 10 is used to produce an opening or hole in the tubular member 26. As illustrated in FIG. 1, the plunger 28 is raised such that the shoulder 41 of the forming member 36 engages the shoulder 55 of the center support member 50. Upon completion of hydroforming, the tubular member 26 is in intimate contact with a wall of the cavity portions 18 and 20 of the lower die half 14 and upper die half 16, respectively, the button 68, and the center support member 50 as illustrated in FIG. 1.

Figure 2:
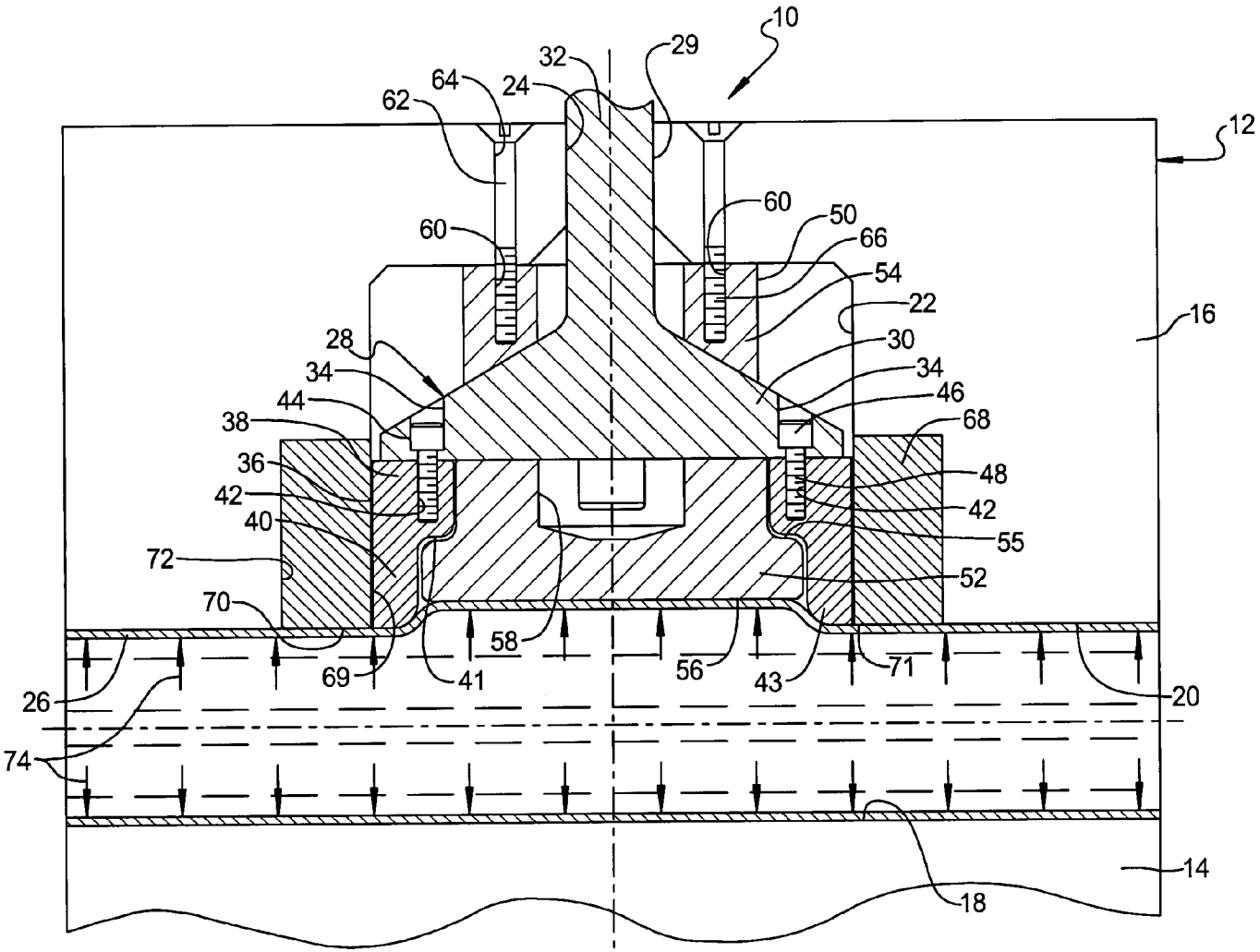
FIG. 2 is a view similar to FIG. 1 illustrating a first step of a piercing process.

Referring to FIG. 2, a hydroforming fluid 74 (indicated by the arrows) in the tubular member 26 is pressurized to a forming pressure of approximately 10,000-psi. At this time, the tubular member 26 is formed and takes a shape of the cavity portions 18 and 20 by becoming in intimate contact with all die cavity surfaces including the tube contact surface 56 of the center support member 50 and around the arcuate surface 43 of the forming member 36 of the plunger 28.

Figure 3:
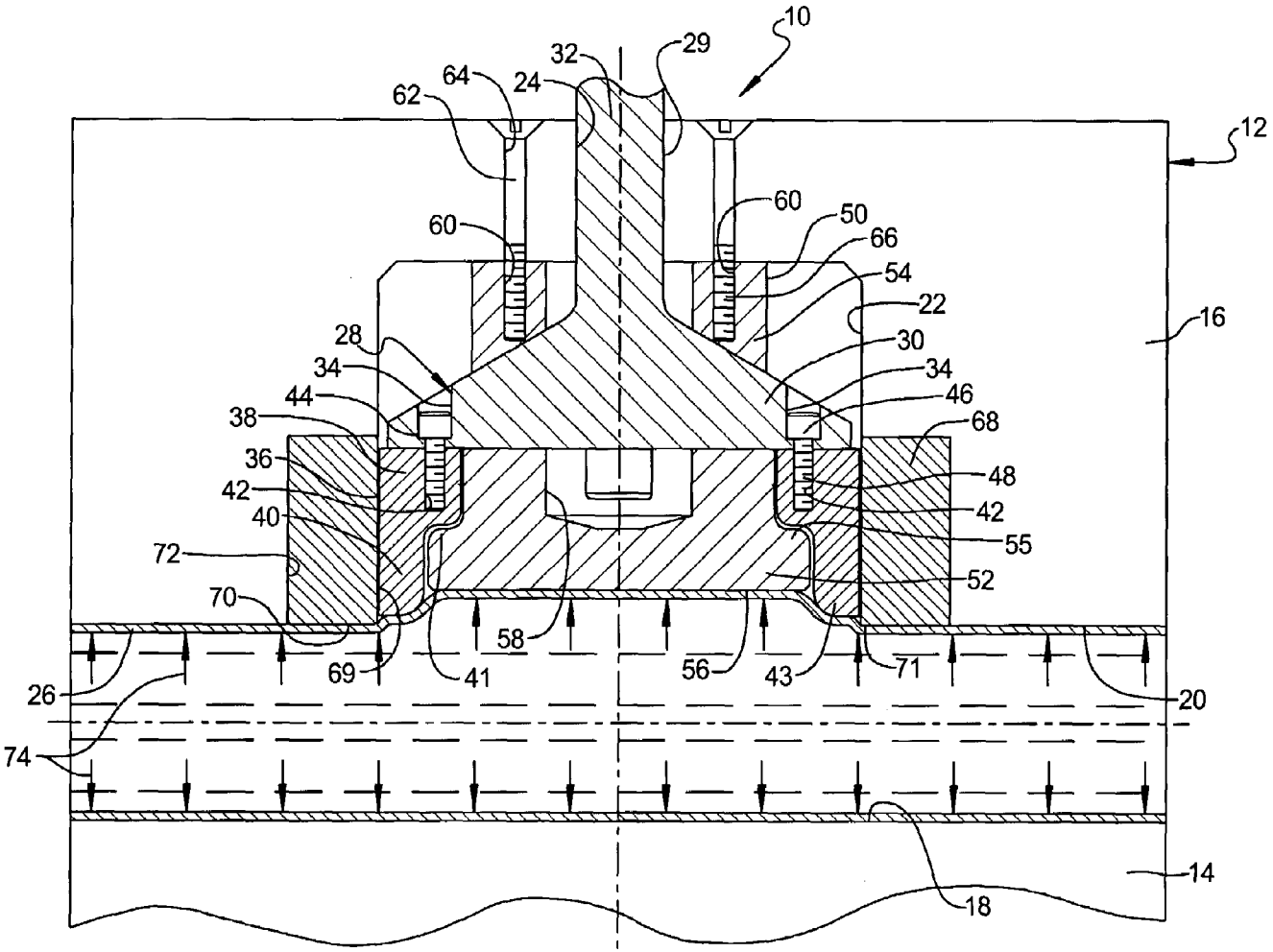
FIG. 3 is a view similar to FIG. 1 illustrating a second step of a piercing process.
Figure 4:
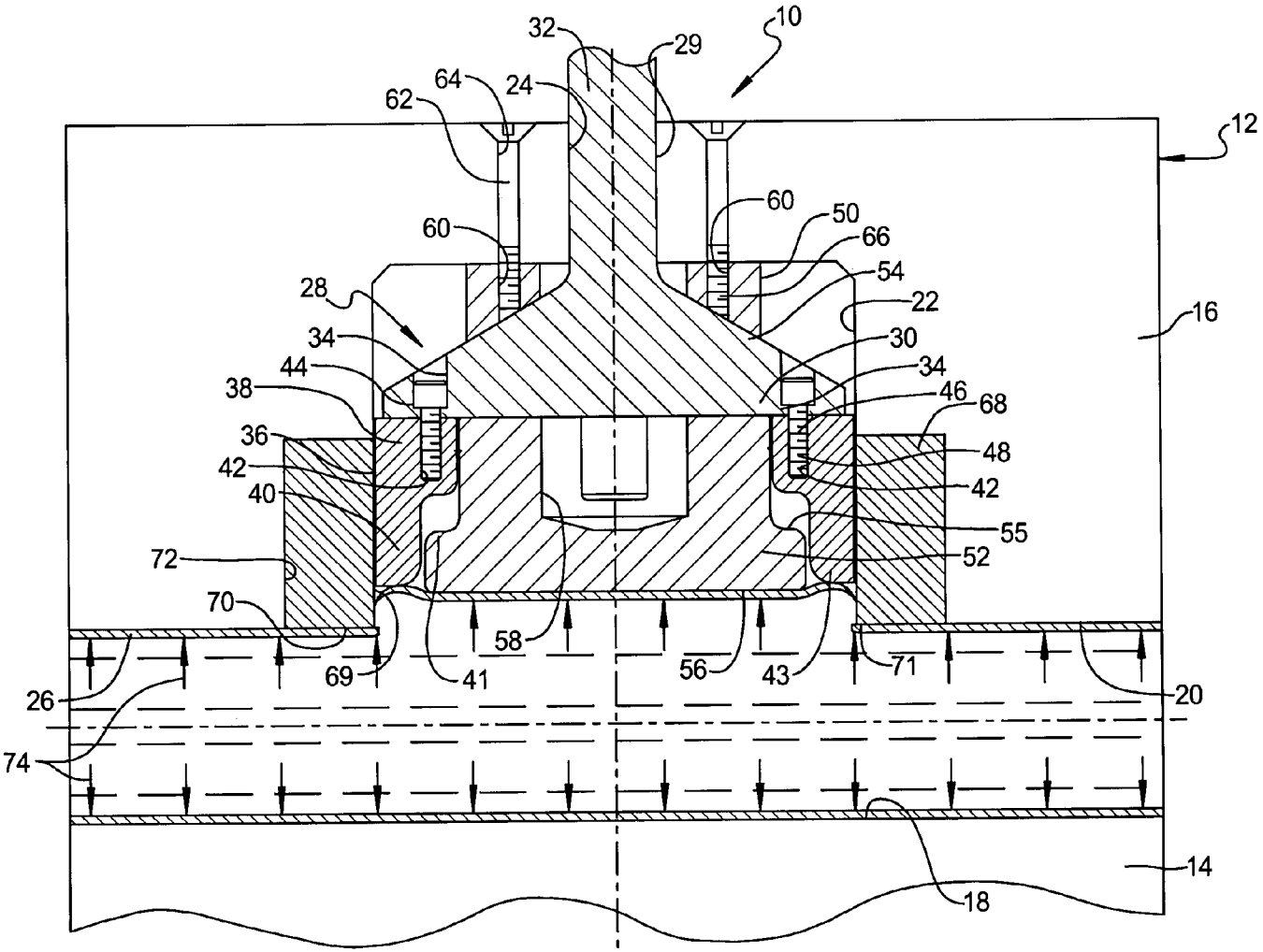
FIG. 4 is a view similar to FIG. 1 illustrating a third step of a piercing process.

When the hydraulic cylinder (not shown) is retracted, the high-pressure fluid 74 will force a wall portion 76 of the tubular member 26 outward, following the plunger 28 as illustrated in FIG. 3. When this occurs, the wall portion 76 of the tubular member 26 is sheared by the sharp edge 71 of the button 68 and produces a slug 78 as illustrated in FIG. 4. It should be appreciated that, when shearing occurs to produce the slug 78, an opening 80 is formed in the tubular member 26.

After shearing, the slug 78 is forced by the forming pressure into the button 68. An edge 82 of the newly produced opening 80 is forced over the tube contact surface 70 of the button 68. It should be appreciated that these conditions will form a complete seal and maintain forming pressure in the tubular member 26 for additional operations.

Figure 5:
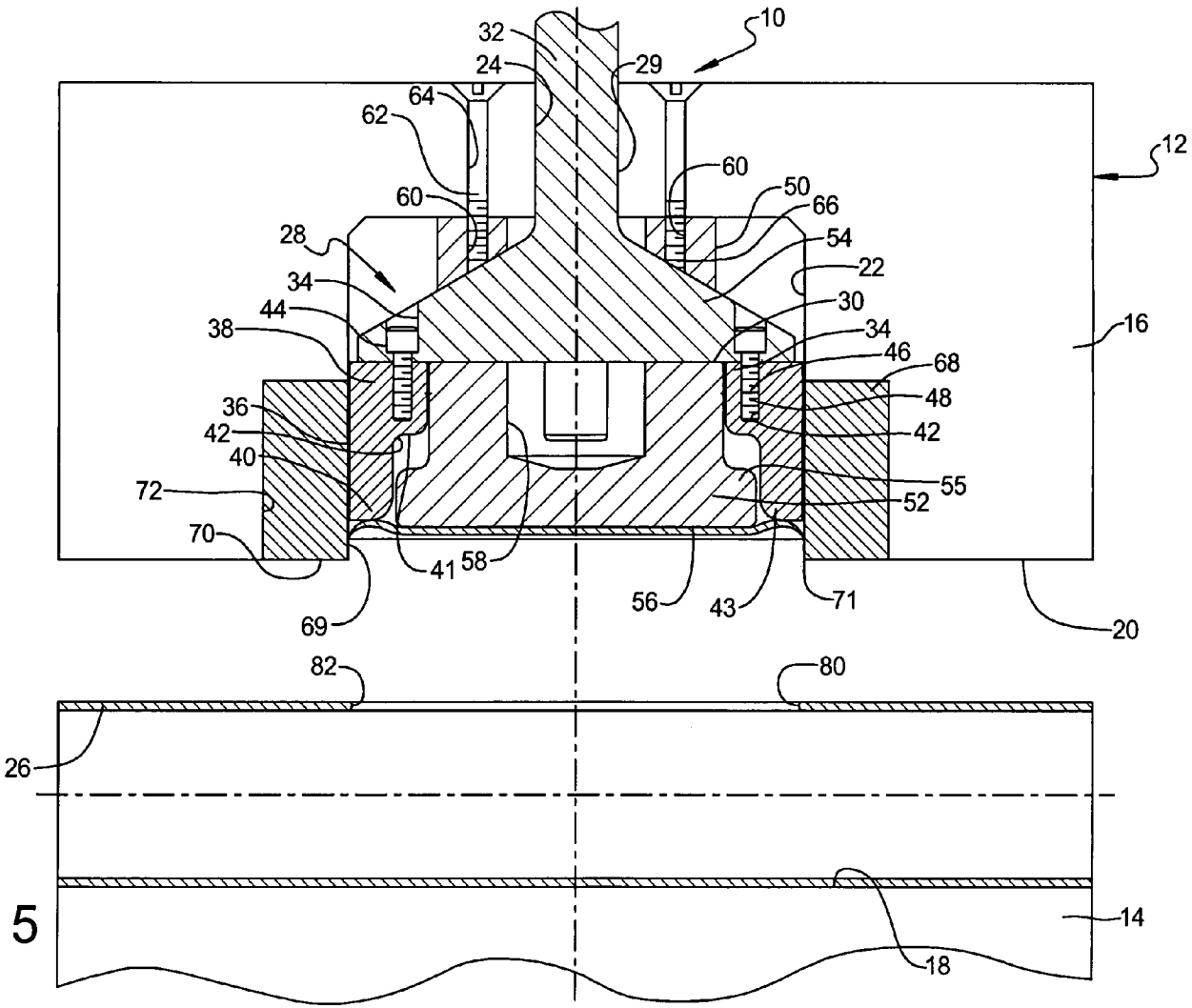
FIG. 5 is a view similar to FIG. 1 illustrating a fourth step of a piercing process.
Figure 6:
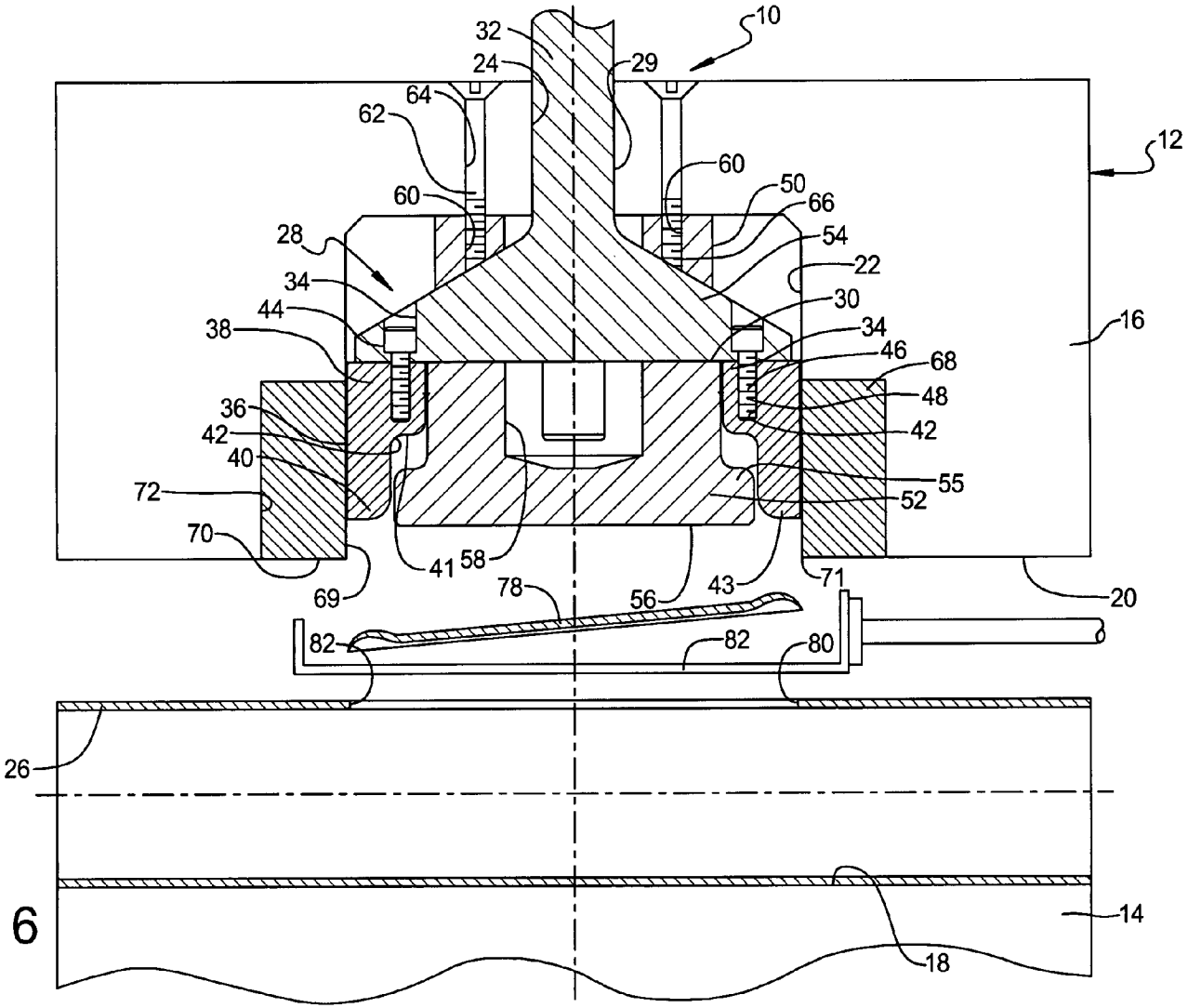
FIG. 6 is a view similar to FIG. 1 illustrating a fifth step of a piercing process.

After the pressure in the tubular member 26 is released and the upper die half 16 is open, the slug 78 will remain press fit in the button 68 as illustrated in FIG. 5. To eliminate the slug 78, the plunger 28 is activated forward or extended, ejecting the slug 78 into a tray 82 for disposal as illustrated in FIG. 6. It should be appreciated that the piercing method is designed to allow more than 50% of the surface of the slug 78 to rest on the stationary center support member 50 and have the cutting around the periphery of the opening 80 be done by the button 68 and the forming pressure, during the retraction of the plunger 28.

Accordingly, the center support punch assembly 10 uses a short stroke for piercing large openings that completely seals internal form pressure and shears only along the periphery of the opening. The application of this piercing method will allow the use of significantly less hydraulic oil flow and will largely increase the real-estate in the hydroform die for better packaging as well as reducing cost due to smaller, more inexpensive hydraulic components.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A center support punch assembly for a hydroforming die comprising:

a center support member for fixed attachment to a die;

a button disposed about and spaced from said center support member for fixed attachment to the die; and a plunger movable relative to said center support member to allow fluid within a tubular member to force a wall portion of the tubular member outward against said center support member and be sheared by said button to produce an opening in the tubular member.

2. A punch assembly as set forth in claim 1 wherein said plunger comprises a plunger member and a forming member attached to said plunger member.

3. A punch assembly as set forth in claim 2 wherein said plunger member comprises a head portion extending radially and a shaft portion extending axially from said head portion.

4. A punch assembly as set forth in claim 2 wherein said forming member comprises a base portion extending radially and disposed adjacent said head portion and an arm portion extending radially from said base portion.

5. A punch assembly as set forth in claim 4 wherein said arm portion has a tube contact surface and an arcuate surface at one end of said tube contact surface.

6. A punch assembly as set forth in claim 2 including a plurality of fasteners to attach said plunger member and said forming member together.

7. A punch assembly as set forth in claim 1 wherein said center support member comprises a base portion extending radially and an aim portion extending axially from said base portion.

8. A punch assembly as set forth in claim 7 wherein said base portion has a tube contact surface.

9. A punch assembly as set forth in claim 7 including a plurality of fasteners for attaching said arm portion to the die.

10. A punch assembly as set forth in claim 1 wherein said button is an annular ring having an aperture extending therethrough with a sharp corner adjacent said aperture.

11. A hydroforming die assembly comprising:

a lower die half having a die forming cavity;

an upper die half having a die forming cavity and a punch cavity extending axially therein and communicating with said die forming cavity; and a center support punch assembly disposed in said punch cavity and operatively supported by said upper die half for piercing an opening in a tubular member disposed between said upper die half and said lower die half;

wherein said center support punch assembly comprises a center support member fixedly attached to said upper die half, a button disposed about and spaced from said center support member and being fixedly attached to said upper die half, and a plunger movable relative to said center support member to allow fluid within a tubular member to force a wall portion of the tubular member outward against said center support member and be sheared by said button to produce an opening in the tubular member.

* * * * *